US007937837B2

(12) United States Patent
Psimadas et al.

(10) Patent No.: US 7,937,837 B2
(45) Date of Patent: May 10, 2011

(54) RAZOR HEAD HAVING TWO SHAVING HEADS

(75) Inventors: Yiannis Psimadas, Athens (GR); Alexis Angelides, Athens (GR); Dimitris Efthimiadis, Athens (GR)

(73) Assignee: BIC-Violex SA, Anixi, Attiki (GR)

( * ) Notice: Subject to any disclaimer, the term of this patent is extended or adjusted under 35 U.S.C. 154(b) by 86 days.

(21) Appl. No.: 11/572,477

(22) PCT Filed: Jul. 22, 2004

(86) PCT No.: PCT/EP2004/009164
§ 371 (c)(1),
(2), (4) Date: Jan. 22, 2007

(87) PCT Pub. No.: WO2006/007874
PCT Pub. Date: Jan. 26, 2006

(65) Prior Publication Data

US 2007/0220752 A1 Sep. 27, 2007

(51) Int. Cl.
*B26B 19/00* (2006.01)

(52) U.S. Cl. ..... 30/34.1

(58) Field of Classification Search ..... 30/34.1, 30/57, 527, 531, 53, 155
See application file for complete search history.

(56) References Cited

U.S. PATENT DOCUMENTS

| | | | | | |
|---|---|---|---|---|---|
| 817,249 | A | * | 4/1906 | Kaufmann | 30/155 |
| 1,791,428 | A | | 2/1931 | Riviere | |
| 2,265,775 | A | * | 12/1941 | McNamara | 30/156 |
| 2,350,805 | A | * | 6/1944 | Olving | 30/34.1 |
| 2,678,490 | A | * | 5/1954 | Winslow | 30/527 |
| 2,802,261 | A | * | 8/1957 | Heyek | 30/34.1 |
| 4,380,869 | A | * | 4/1983 | Shirakawa et al. | 30/34.1 |
| 4,426,776 | A | * | 1/1984 | Kakumoto et al. | 30/34.1 |
| 4,461,078 | A | | 7/1984 | Carreker | |
| 4,498,236 | A | * | 2/1985 | McIntyre et al. | 30/34.1 |
| 5,010,645 | A | | 4/1991 | Furukawa | |
| 5,022,153 | A | * | 6/1991 | Baron | 30/34.1 |
| 5,052,106 | A | * | 10/1991 | Labrijn | 30/34.1 |
| 5,206,994 | A | | 5/1993 | Lin | |
| 5,542,178 | A | * | 8/1996 | Harkleroad | 30/34.1 |
| 5,701,673 | A | * | 12/1997 | Ullmann et al. | 30/34.1 |
| 5,784,785 | A | | 7/1998 | Polites | |
| 6,052,905 | A | * | 4/2000 | Branchinelli et al. | 30/50 |
| 6,314,648 | B1 | * | 11/2001 | Hillebrandt | 30/34.1 |
| 6,526,660 | B1 | * | 3/2003 | MacNeil | 30/50 |
| 6,560,876 | B2 | * | 5/2003 | Carr | 30/34.1 |
| 6,604,287 | B2 | * | 8/2003 | Melton et al. | 30/34.1 |
| 6,684,507 | B2 | * | 2/2004 | Lau et al. | 30/34.1 |
| 6,928,738 | B2 | | 8/2005 | Segrea | |

(Continued)

FOREIGN PATENT DOCUMENTS

DE 19633037 C1 * 5/1997

(Continued)

*Primary Examiner* — Jason Daniel Prone
(74) *Attorney, Agent, or Firm* — Jones Day

(57) ABSTRACT

A razor that includes a handle having an axis, a first shaver head having one or more blades, mounted at a front end of the handle and a second shaver head mounted on a support mounted at a back end of the handle and pivotable with respect to the support between an open position and a closed position. In the open position, the support projects outward from the back end of the handle to allow shaving with the second shaver head and in the closed position, the support is retracted within the handle.

11 Claims, 2 Drawing Sheets

U.S. PATENT DOCUMENTS

| | | | | |
|---|---|---|---|---|
| 7,093,363 | B1 * | 8/2006 | Kuo | 30/47 |
| D540,489 | S * | 4/2007 | Leventhal et al. | D28/46 |
| D540,984 | S * | 4/2007 | Psimadas et al. | D28/48 |
| D541,475 | S * | 4/2007 | Psimadas et al. | D28/48 |
| 7,503,117 | B2 * | 3/2009 | Wetzel et al. | 30/34.1 |
| 7,721,451 | B2 * | 5/2010 | Psimadas et al. | 30/527 |
| 2004/0158990 | A1 * | 8/2004 | Heide | 30/34.1 |
| 2005/0022386 | A1 * | 2/2005 | Macove | 30/50 |
| 2005/0229398 | A1 * | 10/2005 | Leventhal | 30/34.1 |
| 2007/0006463 | A1 * | 1/2007 | Pennella | 30/34.1 |
| 2007/0180699 | A1 * | 8/2007 | Psimadas et al. | 30/34.1 |
| 2007/0214647 | A1 * | 9/2007 | Psimadas et al. | 30/57 |
| 2009/0144984 | A1 * | 6/2009 | Ullmann | 30/77 |
| 2009/0165304 | A1 * | 7/2009 | Blaustein et al. | 30/34.1 |

FOREIGN PATENT DOCUMENTS

| | | | | |
|---|---|---|---|---|
| EP | 0965419 | A1 * | 12/1999 | |
| EP | 0825000 | B1 * | 8/2000 | |
| GB | 205907 | | 10/1923 | |
| JP | 8-257263 | | 10/1996 | |
| JP | 08 257263 | A | 10/1996 | |
| JP | 10076080 | A * | 3/1998 | |
| WO | WO 2005090016 | A1 * | 9/2005 | |
| WO | WO 2006131171 | A1 * | 12/2006 | |

* cited by examiner

RAZOR HEAD HAVING TWO SHAVING HEADS

FIELD OF THE INVENTION

The embodiments of the present invention relate to safety razors and, more specifically, to a razor provided with two shaving heads.

BACKGROUND OF THE INVENTION

Several attempts have been made to propose a razor including at least two shaving heads having different sizes to allow shaving of different hair areas of the body.

U.S. Pat. No. 4,461,078 granted to Carreker discloses a razor assembly including first and second handle portions, with first and second razor heads mounted at the ends of the handle portions. The handle portions are pivotally mounted together so that the heads may be moved from a position wherein the handle portions are substantially in a straight line with the heads widely spaced, to a position wherein the handle portions make a small acute angle with the heads close to each other.

One disadvantage of such a razor is that its handle is near twice as long as a standard razor handle, which makes it difficult to grip comfortably the razor.

U.S. Pat. No. 4,285,124 granted to Diakonov discloses a safety razor comprising a normal sized razor head and a retractable miniature razor head which is movable from a first position where it is retracted behind the normal sized head to a second position where it is deployed above the normal sized head for use in trimming the area beneath the center of the user's nose.

One disadvantage of such a razor is that its structure is quite complicated. That makes the razor difficult to manufacture and, hence, quite expensive.

SUMMARY OF THE INVENTION

It is an object of the embodiments of the present invention to provide a razor having two shaving heads, with improved ergonomics.

The razor according to the embodiments of the present invention comprises a handle having an axis, a first shaving head having one or more blades, mounted at a front end of the handle, and a second shaving head mounted in a support which is mounted at a back end of the handle and is pivotable with respect of the same, between:

- an open position in which said support projects outward from the back end of the handle to allow shaving with said second shaving head, and
- a closed position in which said support is retracted within said handle.

In the closed position, only the first shaving head is available for shaving, while the second one is out of reach, whereas in the open position, the second shaving head is available for shaving.

The shaving heads may have different sizes. For instance, the first shaving head is of standard width, which makes it usable for common purposes (e.g. for shaving cheek hair), while the second one has a small width which makes it usable for particular purposes (e.g. for beard or mustache trimming).

Each razor head may include a removable cartridge which is to be replaced as soon as the blades are dulled.

Latching means may be provided for holding said support in its closed position.

The handle comprises, for example, two parallel arms defining together a housing for receiving the support in its closed position.

The support may be pivotally mounted between respective ends of said arms, while the latching means may comprise an indent protruding from an internal face of each arm, and biasing a lateral face of said support.

In addition, the razor may comprise a stop wall extending between said arms, and against which the support abuts in its closed position.

The support has a rotation axis which is preferably substantially perpendicular to the handle axis.

The above and other objects and advantages of the embodiments of the present invention will become apparent from the detailed description of the preferred embodiments of the invention, considered in conjunction with the accompanying drawings.

Figure 1:
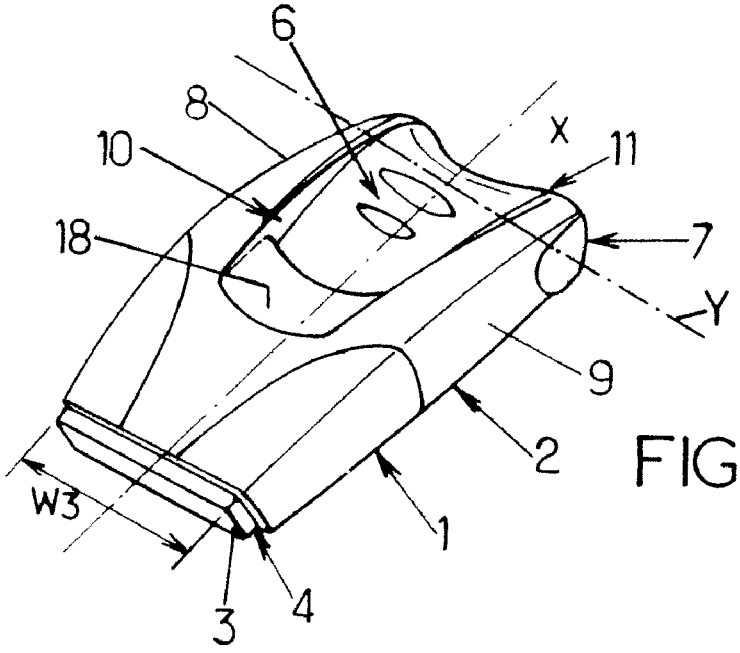
FIG. 1 is a perspective view of a razor having a broad shaving head and a narrow shaving head, shown in a closed position wherein the narrow head is retracted in the handle.

A razor according to the embodiments of the present invention is indicated generally by reference number 1 in the drawings. Razor 1 comprises a handle 2 which has a substantially planar and parallelepipedic shape and extends along a longitudinal axis X.

Razor 1 comprises a first shaving head 3 comprising one or more blades, which is mounted at a front end 4 of the handle 2 so that the edges of the blades are substantially perpendicular to the handle axis X.

Razor 1 also comprises a second shaving head 5 comprising one or more blades substantially perpendicular to the handle axis X. In other words, first head 3 and second head 5 are parallel.

The heads 3, 5 have different sizes, the first one 3 having a standard width W3 while the second one 5 has a width W5 which is less than W3.

First head 3, thereafter called standard head 3, is used in normal shaving (beard, legs), while second head 5, thereafter called narrow head 5, is dimensioned for easy maneuverability to facilitate accurate trimming of particular hair areas, e.g. moustaches or pubic hairs.

Figure 2:
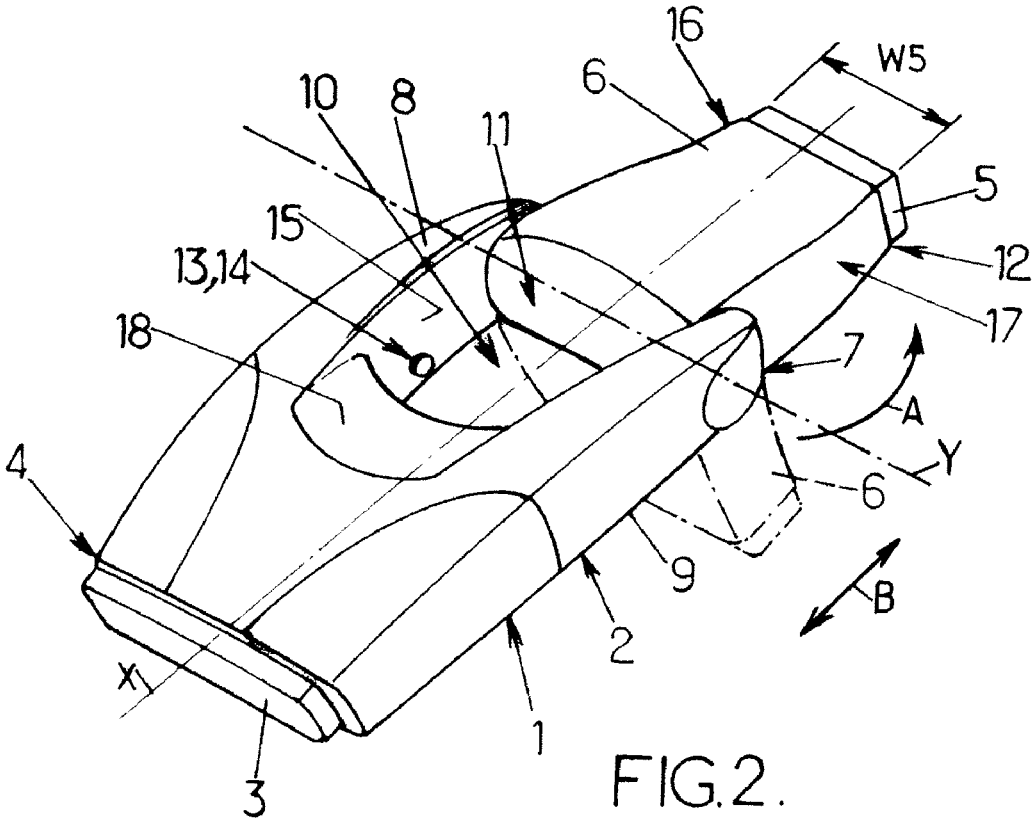
FIG. 2 is a perspective view of the razor of FIG. 1, shown in an open position wherein the narrow shaving head is deployed.

As illustrated in FIG. 2, narrow head 5 is mounted on a support 6 which is mounted on the handle at the back end 7 thereof and is capable of rotating with respect to the handle 2 about an axis Y perpendicular to the handle axis X, between:

- An open position in which the support 6 project outward from the back end 7 of the handle 2 (FIG. 2) and
- a closed position in which the support is retracted and lodged within the handle 2 (FIG. 1).

In the open position, the narrow head 5 is available for shaving, whereas in the closed position, it is out of reach and, hence, not available for shaving.

In the vicinity of the back end 7, the handle 2 has two parallel arms 8, 9 extending in the direction of the axis X and defining together a housing capable of receiving the support 6 which has such a shape that, in closed position, it is lodged within the housing 10 in a complementary manner (FIG. 1, 5).

Figure 5:
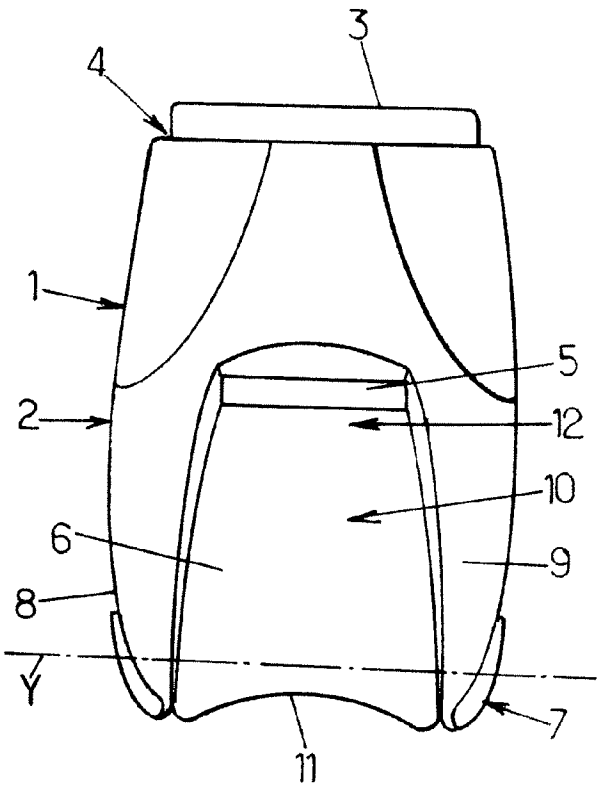
FIG. 3-5 are, respectively, a top plan view, a side view and a bottom view of the razor of FIG. 1, shown in its closed position.
Figure 4:
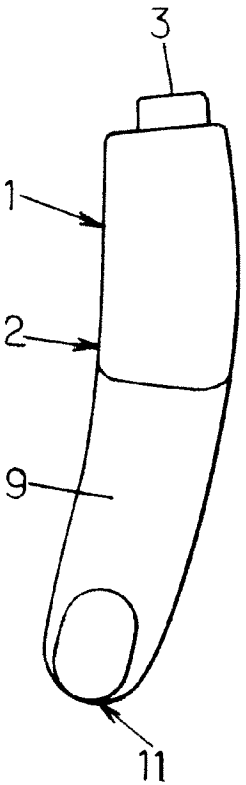

As illustrated in FIGS. 2 and 5, the rotating support 6 has a broad end 11, by which it is pivotally mounted on the handle 2 (e.g. by means of spindles), and a narrow end 12 onto which the narrow head 5 is attached. The plane of the blades for standard head 3 is perpendicular to the handle axis. In addition, the plane of the blades for the narrow head 5 is perpendicular to the handle axis in both the closed position of the narrow head 5 shown in FIG. 1 and the open position of the narrow head 5 shown in FIG. 2.

Razor 1 also comprises latching means 13 to hold the support 11 in its retracted position. Latching means 13 comprise a protrusion 14 which protrudes from an internal face 15 of each arm 8, 9, and which biases a corresponding lateral face 16, 17 of the support 6, so that the support 6 can be clipped closed by the user from the open position.

Handle 2 is provided, on a top side thereof, with a stop wall 18, extending between the arms 8, 9, which partly closes the housing 10 and against which the support 6 abuts in the closed position.

Figure 3:
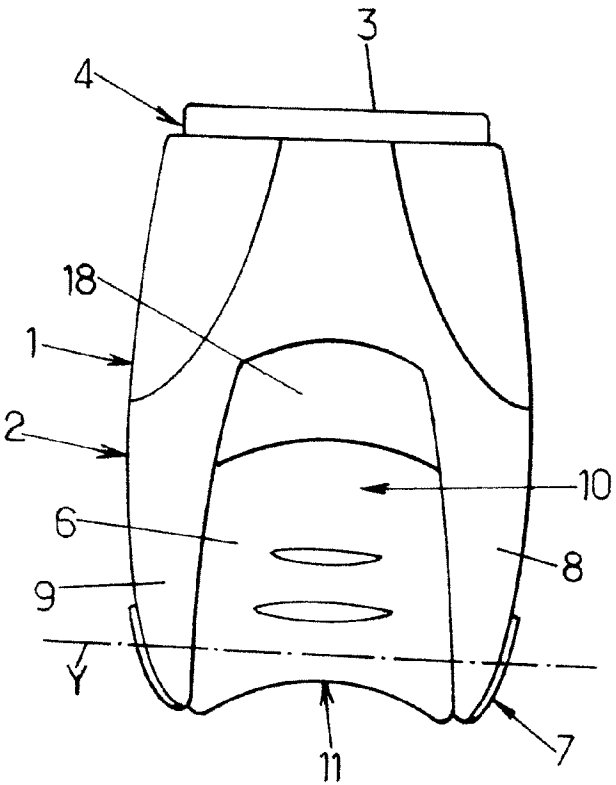

Accordingly, the stop wall 18 and the protrusions 14 hold together the support 6 in its closed position. Also, when the second shaver head 5 is in the closed position, a first side of the second shaver head 5 is covered by the stop wall 18 as shown in FIGS. 2 and 3 while a second side of the second shaver head 5, a majority of a first side of the support 6, and a second side of the support 6 are all exposed as shown FIGS. 3 and 5.

The user is thereby allowed to selectively utilize the standard head 3 or the narrow one 5, whichever is the most convenient to him/her.

During use of the standard head 3, the narrow head 5 is hidden within the handle 2, so that the razor is compact and ergonomic. Moreover, there is no risk for the user to cut his/her fingers with the narrow head 5 or to damage the blades.

In order to utilize the narrow head 5, the user simply pushes the support 6 open (in the direction of arrow A on FIG. 2).

During use of the narrow head 5, standard head 3 may be covered with a protective cap (not shown) , in order to prevent any finger cutting or blade damaging.

The support 6 may be maintained by the user, while shaving with the narrow head 5, in any position intermediate between the closed position illustrated in FIG. 1 and the wide open position shown in FIG. 2 in dark lines, depending on the way the user wishes to hold the razor 1 while shaving with the narrow head 5.

For instance, the support 6 may be held by the user in a position, shown in dashed lines on FIG. 2, wherein it forms a right angle with the handle 2, allowing the user to grasp the handle 2 and/or the support 6 in such a manner that shaving with the narrow head 5 is achieved by movements along a direction parallel to the handle axis X, as shown by arrow B on FIG. 2. In addition, razor 1 may be either entirely disposable or have a reusable handle 2.

In the first case, the heads 3, 5 are permanently attached to the handle 2, so that as soon as the edges are dulled the entire razor 1 is disposed of.

In the second case, each head 3,5 consists of a replaceable cartridge which is removably attached to the support 6 so that after the edges are dulled only the cartridges are disposed of and replaced by new ones. One skilled in the art may be inspired by existing disposing mechanism (see e.g. U.S. Pat. No. 4,492,024).

The invention claimed is:

1. A razor comprising:

a handle having a longitudinal axis and a back end, wherein the back end includes at least two parallel arms defining a housing;

a first shaver head having one or more blades, mounted at a front end of the handle;

a second shaver head having a first side and a second side mounted on a support which has two lateral faces, a first side, and a second side and which is mounted between the at least two parallel arms and pivotable with respect to the handle between an open position, wherein the support projects outward from the back end of the handle to allow shaving with the second shaver head and a closed position, wherein the support is retracted within the handle when received in the housing;

a latching means for holding the support in the closed position, the latching means including a protrusion protruding from an internal face of each of the arms, the protrusion of each of the arms biasing a respective one of the two lateral faces of the support; and a stop wall disposed on a top side of the razor extending between the at least two parallel arms, and against which the support abuts in the closed position, wherein the stop wall and the arms delimiting a through aperture provided on the housing to allow the support retracted in the recess to be pushed open through the through aperture in order to pivot the second shaver head to the open position, wherein when the second shaver head is in the closed position, the first side of the second shaver head is covered by the stop wall while the second side of the second shaver head, a majority of the first side of the support, and the second side of the support are all exposed, and wherein the one or more blades of the first shaver head define a first plane and a working portion of the second shaver head defines a second plane, wherein the first plane is perpendicular to the longitudinal axis and the second plane is perpendicular to the handle axis when the second shaver head is in the open or closed position.

2. A razor according to claim 1, wherein said first shaver head and said second shaver head have different sizes.

3. A razor according to claim 2, wherein said first shaver head has a width greater than said second shaver head.

4. A razor according to claim 1, wherein the support has a rotation axis substantially perpendicular to the longitudinal axis.

5. A razor according to claim 1, wherein the first razor head and the second razor head include a removable cartridge.

6. A razor comprising:

a handle having a longitudinal axis and a back end, wherein the back end includes at least two parallel arms defining a housing;

a first shaver head having one or more blades each having an edge, the edges of the one or more blades of the first shaver head being substantially perpendicular to the longitudinal axis, the first shaver head being mounted at a front end of the handle;

a second shaver head having a first side, a second side and one or more blades each having an edge, the edges of the one or more blades of the second shaver head being substantially perpendicular to the longitudinal axis, the second shaver head being mounted on a support which has two lateral faces, a first side, and a second side and which is mounted between the at least two parallel arms and pivotable with respect to the handle between an open position wherein the support projects outward from the back end of the handle to allow shaving with the second shaver head and a closed position wherein the support is retracted within the handle when received in the housing;

a latching means for holding the support in the closed position, the latching means including a protrusion protruding from an internal face of each of the arms, the protrusion of each of the arms biasing a respective one of the two lateral faces of the support; and a stop wall disposed on a top side of the razor extending between the at least two parallel arms, and against which the support abuts in the closed position, wherein the stop wall and the arms delimiting a through aperture provided on the housing to allow the support retracted in the recess to be pushed open through the through aperture in order to pivot the second shaver head to the open position, wherein when the second shaver head is in the closed position, the first side of the second shaver head is covered by the stop wall while the second side of the second shaver head, a majority of the first side of the support, and the second side of the support are all exposed, and wherein the one or more blades of the first shaver head define a first plane and the one or more blades of the second shaver head defines a second plane, wherein the first plane is perpendicular to the longitudinal axis and the second plane is perpendicular to the longitudinal axis when the second shaver head is in the open or closed position.

7. A razor according to claim 6, wherein the first shaver head and the second shaver head have different sizes.

8. A razor according to claim 6, wherein the first shaver head has a width greater than the second shaver head.

9. A razor according to claim 6, wherein the support has a rotation axis substantially perpendicular to the longitudinal axis.

10. A razor according to claim 6, wherein the first razor head and the second razor head include a removable cartridge.

11. A razor comprising:

a handle having a longitudinal axis and a back end, wherein the back end includes at least two parallel arms defining a housing having an upper and lower face;

a first shaver head having one or more blades, mounted at a front end of the handle;

a second shaver head having a first side and a second side mounted on a support which has two lateral faces, a first side, and a second side and which is mounted between the at least two parallel arms and pivotable with respect to the handle between an open position wherein the support projects outward from the back end of the handle to allow shaving with the second shaver head and a closed position, wherein the support is retracted within the handle when received in the housing toward the upper face;

wherein the support includes a broad end and a narrow end, the broad end being the end on which the second shaver is mounted to the at least two parallel arms, the narrow end being the end on which the second head is mounted, a latching means for latching the support in the closed position, the latching means including a protrusion protruding from an internal face of each of the arms, the protrusion of each of the arms biasing a respective one of the two lateral faces of the support; and a stop wall disposed on a top side of the razor and extending between the at least two parallel arms, and against which the support abuts in the closed position, wherein the stop wall and the arms delimiting a through aperture provided on the housing to allow the support retracted in the recess to be pushed open from the upper face through the through aperture in order to pivot the second shaver head to the open position, wherein when the second shaver head is in the closed position, the first side of the second shaver head is covered by the stop wall while the second side of the second shaver head, a majority of the first side of the support, and the second side of the support are all exposed, and wherein the one or more blades of the first shaver head define a first plane and a working portion of the second shaver head defines a second plane, wherein the first plane is perpendicular to the longitudinal axis and the second plane is perpendicular to the handle axis when the second shaver head is in the open or closed position.

* * * * *